US005118986A

United States Patent [19]

Ohnuma et al.

[11] Patent Number: 5,118,986

[45] Date of Patent: Jun. 2, 1992

[54] ELECTROLUMINESCENT DEVICE

[75] Inventors: Teruyuki Ohnuma; Fumio Kawamura, both of Shizuoka; Masafumi Ohta, Susono; Yohta Sakon, Numazu; Toshihiko Takahashi, Numazu; Mitsuru Hashimoto, Numazu, all of Japan

[73] Assignee: Ricoh Company, Ltd., Tokyo, Japan

[21] Appl. No.: 541,533

[22] Filed: Jun. 21, 1990

[30] Foreign Application Priority Data

Jun. 30, 1989 [JP] Japan ..... 1-168825
Jul. 21, 1989 [JP] Japan ..... 1-189342

[51] Int. Cl.[5] ..... H05B 33/00

[52] U.S. Cl. ..... 313/504; 313/498; 252/301.44

[58] Field of Search ..... 313/504, 498, 509, 499; 428/917; 252/301.6 S, 301.4 H, 301.4 R; 430/82

[56] References Cited

U.S. PATENT DOCUMENTS 4,209,327 6/1980 Ohta et al. ..... 430/82

FOREIGN PATENT DOCUMENTS 54-59142 5/1979 Japan .
54-90927 7/1979 Japan .
56-22437 3/1981 Japan .
57-51781 3/1982 Japan .
59-194393 11/1984 Japan .

*Primary Examiner*—Donald J. Yusko
*Assistant Examiner*—Nimeshkumar D. Patel
*Attorney, Agent, or Firm*—Oblon, Spivak, McClelland, Maier & Neustadt

[57] ABSTRACT

An electroluminescent device having:
an anode and a cathode; and
at least two organic compound layers sandwiched between said two electrodes,
at least one of said organic compound layers being a hole transporting layer containing a compound represented by the following general formula (I)

wherein $R^1$ represents hydrogen atom, a lower alkyl group, a lower alkoxy groups, a halogen or a nitro group, A represents (wherein $R^2$ represents a lower alkyl group, a substituted or non-substituted aryl group or an aralkyl group, and $R^3$ represents a lower alkyl group.)

15 Claims, 1 Drawing Sheet

ELECTROLUMINESCENT DEVICE

BACKGROUND OF THE INVENTION

The present invention relates to an electroluminescent device which is capable of directly converting electric energy of an electric field applied thereto into light energy and capable of producing a large surface-area luminescence different from conventional incandescent lamps, fluorescent lamps and light-emitting diodes.

Electroluminescent devices produced by laminating thin films of inorganic compounds are known. In such inorganic thin-film electroluminescent devices, a transparent electrode (ITO), an insulating layer ($Si_3N_4$), a luminescent layer (ZnS : Mn), an insulating layer ($Si_3N_4$) and a metal electrode (Al) are laminated in sequence on a glass substrate. Although such inorganic thin-film electroluminescent devices have high luminance, they need a high driving voltage of from 100 to 200 V, and therefore, the use of an exclusive IC which withstands a high voltage force is required. Furthermore, a matrix material for the luminescent layer and a material used as an active agent are limited, and it is not always possible to obtain an electroluminescent device having high luminance at a desired wavelength.

In recent years, attempts have been made to manufacture an electroluminescent device in which organic thin films are laminated.

Such electroluminescent devices are disclosed in, for example, Japanese Patent Application Laid-Open (KOKAI) No. 194393/1984. This electroluminescent device is composed of an anode, a hole transporting zone, an organic luminescent zone, and a cathode, in which the organic electroluminescent zone is less than 1 μm, and either of the anode or the cathode is capable of permeating at least 80% of radiation rays at a wavelength of 400 nm or above, and either has a power conversion efficiency of $9\times10^{-5}$ W/W. As hole transmitting compounds constituting the hole transmitting layer, 1,1-bis(4-di-p-tolylaminophenyl)-4-phenylcyclohexane, 1,1-bis(4-di-p-tolylaminophenyl) cyclohexane, 4,4''-bis (diphenylamino) quatriphenyl, bis(4-dimethylamino-2-methylphenyl) phenylmethane, and N,N-tri(p-tolyl) amine may be exemplified.

Japanese Patent Application Laid-Open (KOKAI) No. 51781/1982 discloses an organic electroluminescent device comprising an anode, a cathode, an electroluminescent zone sandwiched therebetween which contains at least one type of organic electroluminescent substance and a binding agent having a breakdown voltage of more than about $10^5$ V/cm, and a hole transporting zone sandwiched between the electroluminescent zone and the anode, including a porphyrin compound layer. As the porphyrin compounds of the hole transmitting compounds, phthalocyanine and metallic phthalocyanine of cobalt, magnesium, zinc, palladium, nickel, copper, lead or platinum may be exemplified.

In the above-described organic thin-film electroluminescent devices, as compared with the inorganic electroluminescent, the choice in materials for the luminescent layer has been carried out on a large scale and materials capable of light emission of various wavelengths have been found. Furthermore, since the organic thin-film electroluminescent devices have generally a driving voltage force from 5 to 60 V and facilitate large surface area luminescence. So, application of the electroluminescent device to various types of electroluminescent or display devices including a full-color display, has been expected.

However, researches on the electroluminescent devices using organic compounds as a luminescent material have not been gone deep into and it can be said that sufficient studies with respect to the materials and device-forming techniques have been made. So, there are many problems with respect to improvement in luminance, control of the wavelength of the light emission, and improvement in durability.

As a result of the present inventors' earnest studies with respect to at least two organic compound layers sandwiched between two electrodes for providing an electroluminescent devices which can be driven at a low voltage, maintain its luminosity for a long period, control easily on the wavelength of the light emission and has excellent durability, it has been found that an electroluminescent device having at least one of the organic compound layers comprising as a hole transporting substance an organic compound represented by the following general formula, can drive at a low voltage and can provide an emission light of high luminance for a long period.

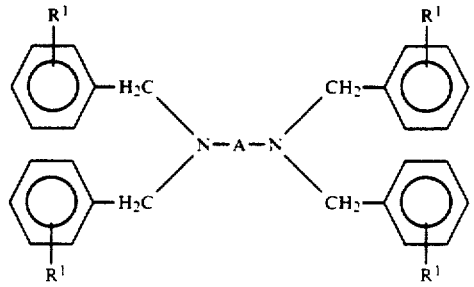

(I)

(wherein $R^1$ represents hydrogen atom, a lower alkyl group, a lower alkoxy group, a halogen atom or nitro group, and A represents

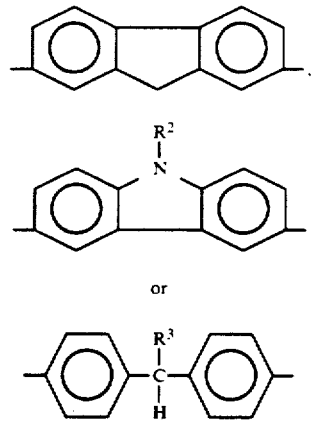

in which $R^2$ represents a lower alkyl group, a substituted or non-substituted aryl group or an aralkyl group, and $R^3$, represents a lower alkyl group.) The present invention has been attained based on this finding.

SUMMARY OF THE INVENTION

In an aspect of the present invention, there is provided an electroluminescent device comprising an anode, a cathode, and at least two organic compound layers sandwiched between the said two electrodes, at least one layer of the said organic compound layers being a hole transporting layer which contains a compound represented by the following general formula (I).

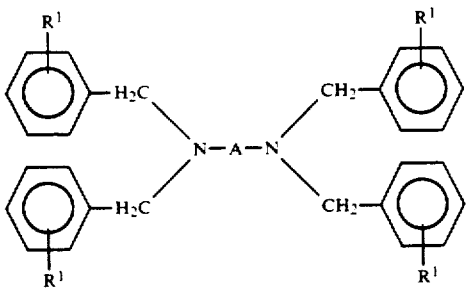

(I)

(wherein $R^1$ represents hydrogen atom, a lower alkyl group, a lower alkoxy group, a halogen atom or nitro group, and A represents

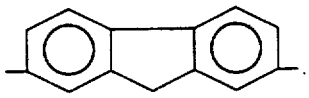

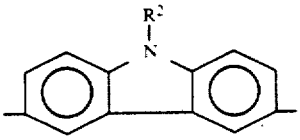

or

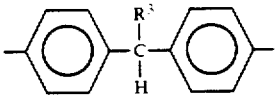

in which $R^2$ represents a lower alkyl group, a substituted or non-substituted aryl group or an aralkyl group, and $R^3$ represents a lower alkyl group.)

DETAILED DESCRIPTION OF THE INVENTION

An electroluminescent device according to the present invention includes at least one hole transporting layer comprising a hole transporting substance represented by the general formula (I). The hole transporting layer is sandwiched between two electrodes.

In the general formula (I), R' represents hydrogen atom; a lower alkyl group, preferably ($C_1$-$C_5$) alkyl group, more preferably ($C_1$-$C_4$) alkyl group; a lower alkoxy group, preferably ($C_1$-$C_4$) alkoxy group, more preferably ($C_1$-$C_2$) alkoxy group; a halogen atom, preferably chlorine atom and bromine atom; or nitro group.

A represents

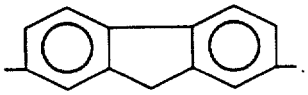

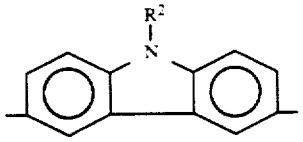

or

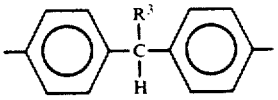

wherein $R^2$ represents a lower alkyl group, preferably ($C_1$-$C_4$) alkyl group, more preferably ($C_1$-$C_2$) alkyl group; a substituted or non-substituted aryl group; or an aralkyl group, preferably ($C_7$-$C_{12}$) aralkyl group, more preferably a phenyl group; and $R^3$ represents an alkyl group, preferably ($C_1$-$C_{10}$) alkyl group, more preferably, ($C_2$-$C_7$) alkyl group.

The substances disclosed in Japanese Patent Application Laid-Open (KOKAI) Nos. 22437/1981, 59142/1979 (U.S. Pat. No. 4209327) and 90927/1979 can be exemplified as the compound represented by the general formula (I). As examples of such substances, the following compound are exemplified.

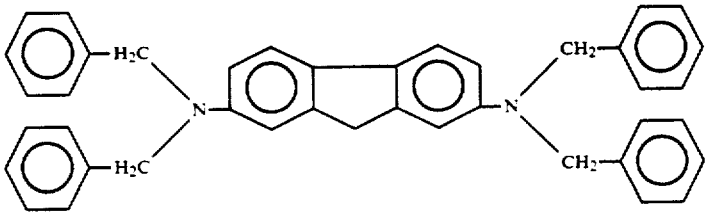

(Compound No. 1)

-continued
(Compound No. 2)
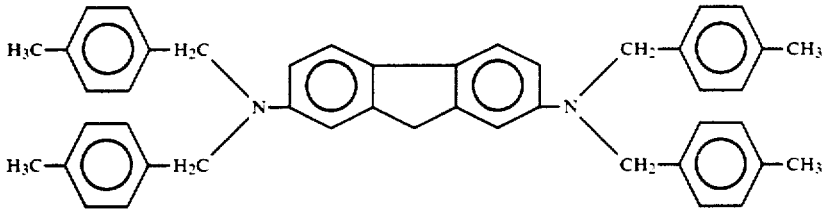
(Compound No. 3)
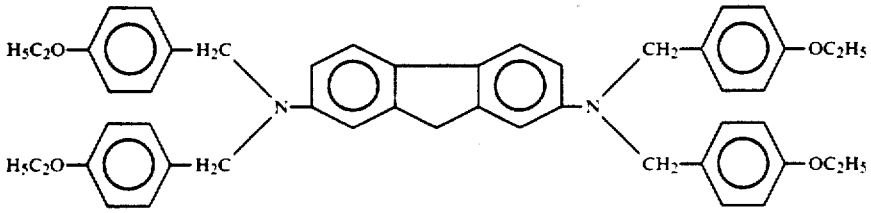
(Compound No. 4)
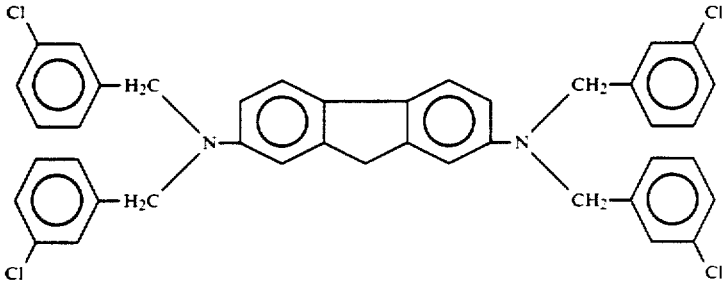
(Compound No. 5)
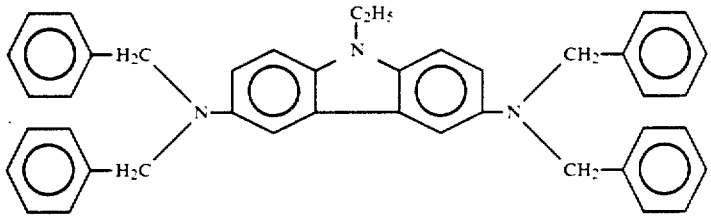
(Compound No. 6)
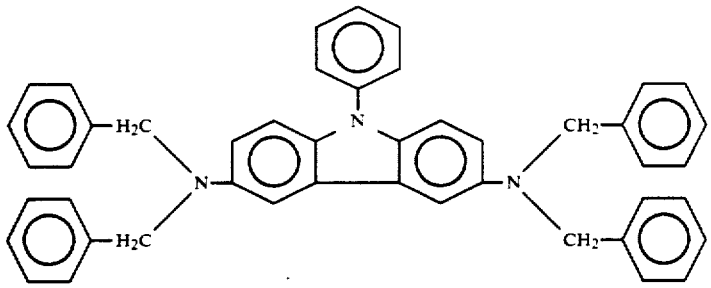
(Compound No. 7)
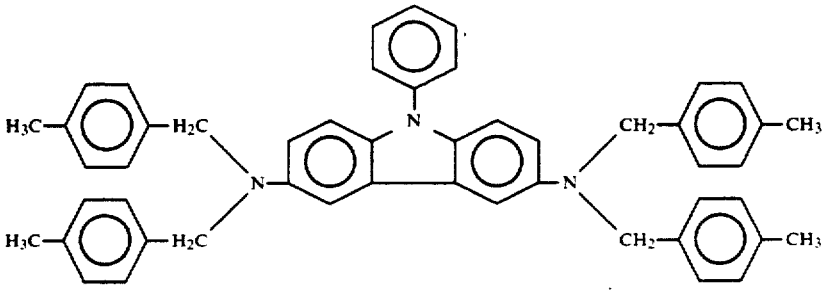

-continued

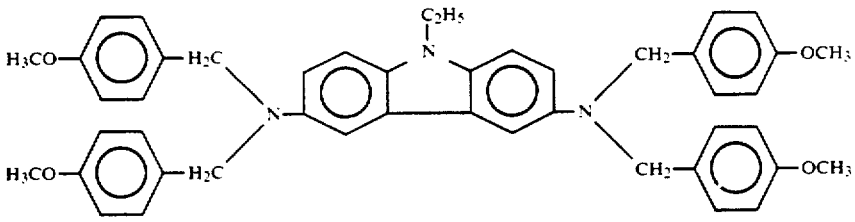

(Compound No. 8)

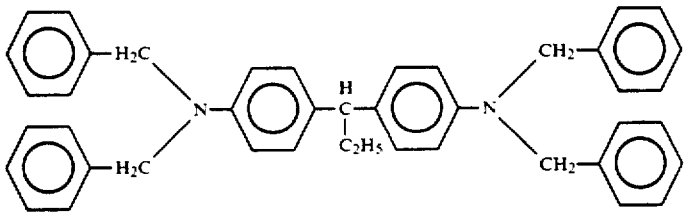

(Compound No. 9)

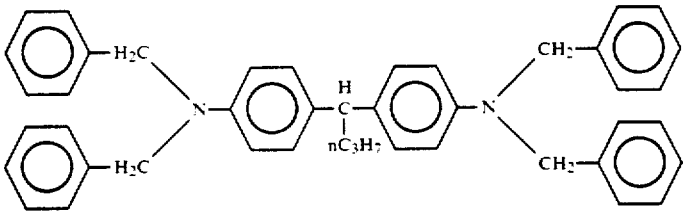

(Compound No. 10)

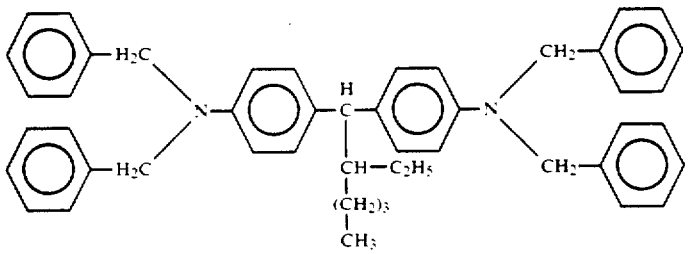

(Compound No. 11)

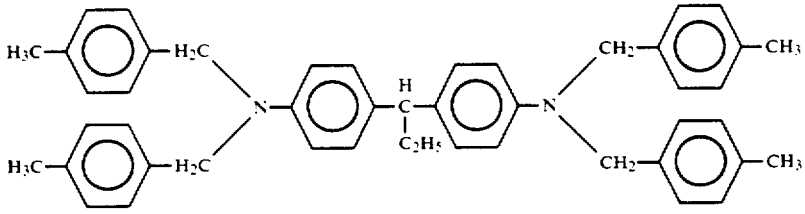

(Compound No. 12)

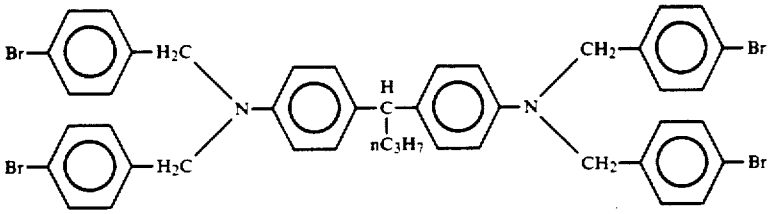

(Compound No. 13)

Figure 1:
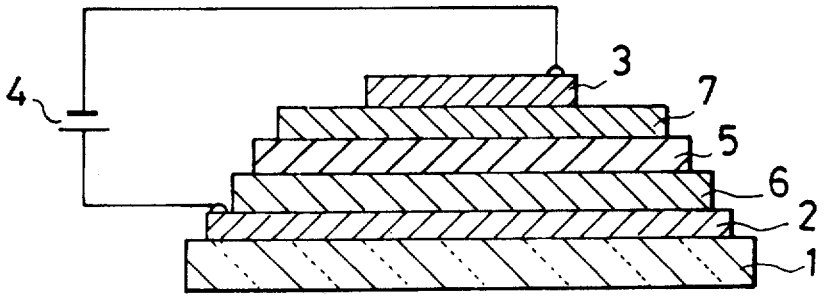
FIG. 1 and 2 are cross-sectional views of a representative electroluminescent device according to the present invention.

FIG. 1 shows an example of the organic thin-film electroluminescent device according to the present invention. In the FIG. 1, the electroluminescent device comprises a substrate 1, an anode 2, a cathode 3, a power source 4, a luminescent layer 5, a hole transporting layer 6, and an electron transporting layer 7. On the substrate 1 the electrodes and the luminescent layer are formed. Glass substrate is generally used as the substrate 1. The luminescent characteristics and reliability of the electroluminescent device are affected by the quality and surface condition of the substrate 1, so the substrate must be a material which exhibits excellent heat-resistance and chemical resistance. Non-alkali boro-silicate glass polished by photomask grade is preferably used.

Both anode 2 and cathode 3 are connected to the power source 4, and generate an electric field therebetween in which the respective layers of the electroluminescent device are disposed.

In order to improve the hole injecting efficiency in which holes are injected into the hole transporting layer 6, a conductive material having a great work function is used as the anode 2. For taking out the light emitted from the electroluminescent layer 5 with high efficiency, it is preferable that a material has a light transmittance of 80% in the region of luminous wavelength thereof as the anode 2. In practice, nickel, gold, platinum, palladium, an alloy of these metals, tin oxide ($SnO_2$) or indium tin oxide (ITO) is preferably used. The thickness of the anode 2 is 100 to 5,000 Å, preferably 200 to 2,000 Åin case of using $SnO_2$ or ITO as the mode. In a case where the material such as nickel and gold which is originally opaque to the visible light region is used as the anode 2, the thickness of the anode is preferably 50 to 250 Å so as to attain sufficient transparency.

In order to improve the electron injecting efficiency in which electrons are injected into the electron transporting layer 7, a conductive material having a small work function, such as silver, tin, lead, magnesium, manganese, aluminum or an alloy of these metals is used as the material of the cathode 3. The thickness of the cathode 3 is preferably not less than 500 Å.

The hole transporting layer 6 and the electron transporting layer 7 act respectively for transporting holes and electrons injected from the electrodes 2 and 3 to the luminescent layer 5. By being disposed between the electrodes and the luminescent layer, the hole transporting layer 6 and the electron transporting layer 7 serve to raise the efficiency in which holes and electrons are injected into the luminescent layer 5. Also, these layers 6 and 7 serve to protect the luminescent layer 5, and improve the insulation and withstand voltage properties of the electroluminescent device. From these viewpoints, each of the hole transporting layer 6 and the electron transporting layer 7 is preferably made of substances which can selectively transport holes or electrons, can form a uniform thin film, and do not generate pin-holes easily. In the luminescent layer 5, the holes and electrons respectively injected from the electrodes 2 and 3 are recombed, thereby emitting light. The thickness of the hole transporting layer 6 is preferably not more than 2,000 Å, and the thickness of the electron transporting layer 6 is preferably not more than 2,000 Å.

Figure 2:
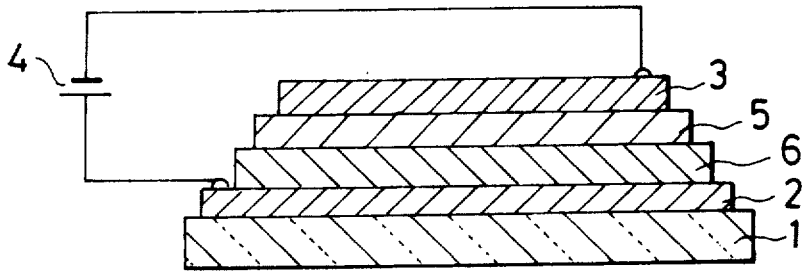

As the material of the luminescent layer, a substance in which holes and electrons are easily injected and which has an agglomeration structure showing a high order property is preferably used. It is also essential that the substance used as the material of the luminescent layer has an intense fluorescence characteristic in a solid state. In the case where a substance in which the electron injection is easily conducted is used as the material of the luminescent layer, the electron transporting layer 7 may be omitted, as shown in FIG. 2.

Figure 3:
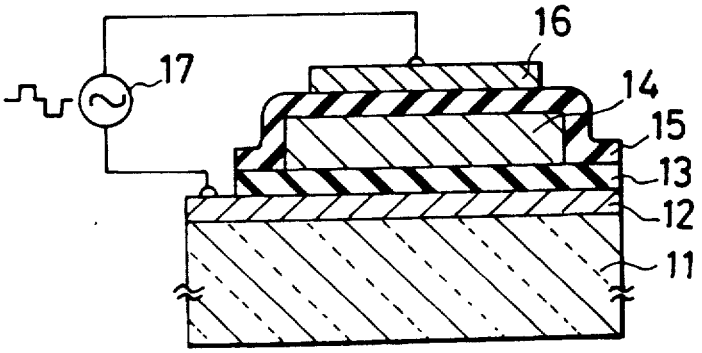
FIG. 3 is a cross-sectional view of a conventional electroluminescent device.

FIG. 3 shows a conventional inorganic thin film electroluminescent device comprising a glass substrate 11, a transparent electrode (ITO) 12, an insulator layer ($Si_3N_4$) 13, a luminescent layer (ZnS : Mn) 14, an insulator layer ($Si_3N_4$) 15 and a metal electrode (Al) 16, which are disposed in sequence. The transparent electrode 12 and the metal electrode 16 are together connected to a power source 17.

Examples of the substances used as the material of the luminescent layer include the compounds disclosed in Japanese Patent Application Laid-Open (KOKAI) No. 194393/1984, U.S. Pat. No. 4720432, U.S. Pat. application, Ser. No. 07/459,326 filed on Dec. 29, 1989, and U.S. Pat. application, Ser. No. (unknown) filed Mar. 28, 1990 (which corresponds to Japanese Patent application Ser. No. 102057/1989).

Examples of the substances used as the material of the electron transporting layer include the compounds disclosed in U.S. Pat. No. 4720432 and U.S. Pat. application, Ser. No. 07/459,326.

The construction of the organic thin layers of the electroluminescent device according to the present invention is not limited to that described above, and a single thin layer containing the aforementioned hole transporting substance may also be used as the organic thin layers.

The organic thin-film electroluminescent device according to the present invention is manufactured by forming the aforementioned thin layers on the surface of the substrate 1. As the film-forming method, a casting method and Langmuir-Blodgett's method, preferably the vacuum vapor deposition method may be used. When the material of the anode 2 is deposited on the substrate 1, in case of using a substance having a high melting point such as ITO, the substance is heated and evaporated by the electron beam heating method. Alternatively, in case of using a substance having a low melting point, the substance is heated and evaporated by the resistance heating method. The degree of vacuum for deposition is not more than $1\times10^{-3}$ Torr, preferably not more than $1\times10^{-5}$ Torr. The distance between the evaporation source and the substrate 1 are preferably not less than 15 cm. When the hole transporting layer 6, the luminescent layer 5, the electron transporting layer 7 and the cathode 3 are deposited on the anode 2 in sequence, a precise control must be conducted on the temperature of the evaporation source boat, the deposition rate and the temperature of the substrate in accordance with the material to be deposited for forming a uniform and fine film.

By connecting the thus form electroluminescent device to a power source through lead wires, the light emission arises. Some substances may be gradually oxidized or absorb water in the air when left in the atmosphere. So, a protective layer may be provided, or the entirety of the electroluminescent device placed in a cell may be sealed with silicone oil.

In the electroluminescent device according to the present invention, since at least one organic compound thin-layer containing a compound represented by the general formula (I) as a hole transporting substance is sandwiched between the electrodes, the electroluminescent device according to the present invention can be driven by applying a low voltage of not more than 30 V, preferably, 5 to 20 V, can maintain a luminance of not less than 10 cd/m$^2$, preferably, not less than 100 cd/m$^2$ for a long time, can easily control the wavelength of the light emission, and exhibits excellent durability.

The present invention will be more precisely explained while referring to Examples as follows.

However, the present invention is not restricted to Examples under mentioned. From the foregoing description, one skilled in the art can easily ascertain the essential characteristics of this invention, and without departing from the spirit and scope thereof, can make various changes and modification of the invention to adapt it to various usages and conditions.

EXAMPLE 1

After the substrate of non-alkali boro-silicated glass having a thickness of 1.1 mm was washed thoroughly, an ITO thin-film was deposited to a thickness of about 500 Å on the glass substrate by the electron beam deposition to form an anode.

Next, the following compound No. 1 was deposited to a thickness of 800 Å on the anode by vacuum vapor deposition to form a hole transporting layer.

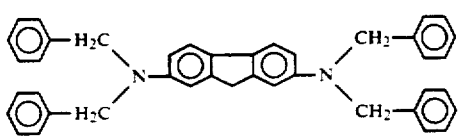

(No. 1)

Subsequently, 8-hydroxyquinoline aluminum represented by the following formula was deposited to a thickness of about 800 Å on the hole transporting layer to form a luminescent layer,

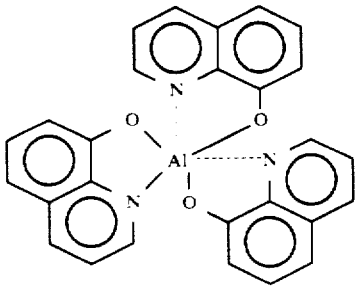

and magnesium was then deposited to a thickness of about 1,000 Å on the luminescent layer to form a cathode, thereby obtaining an electroluminescent device shown in FIG. 2. The materials of the hole transporting layer the luminescent layer and the cathode were evaporated by the resistance heating method. Thereafter, the leads were connected to the anode and the cathode, and to a D.C. power source. When a current was supplied to the thus-formed electroluminescent device, bright light emission was observed. It was also found that this electroluminescent device possessed the following characteristics:

Color of radiation : yellow green
Light emission starting voltage : +7 V
Driving current : 0.5 to 5 mA/cm$^2$

EXAMPLES 2 to 7

Electroluminescent devices of Examples 2 to 7 were manufactured in the same manner as Example 1 except for using compounds as shown in Table 1 instead of the compound represented by the formula No. 1 which was used in Example 1 as the hole transporting substance.

The characteristics of the obtained electroluminescent devices are shown in Table 1.

The compounds Nos. 2, 5, 6, 9, 10 and 11 in Table 1 are as follows.

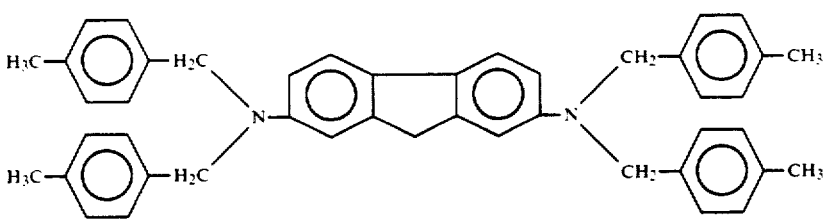

(No. 2)

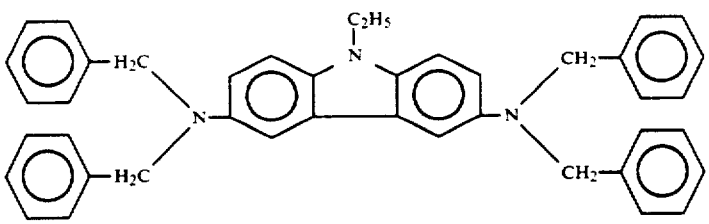

(No. 5)

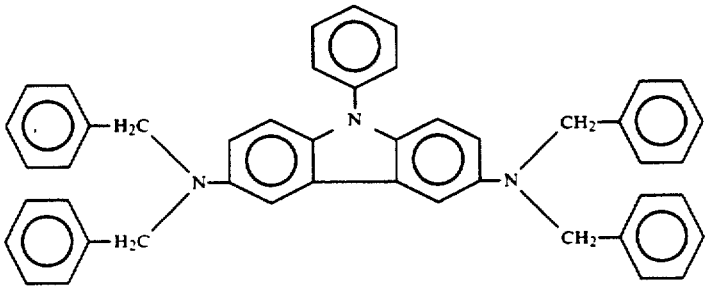

(No. 6)

-continued (No. 9)

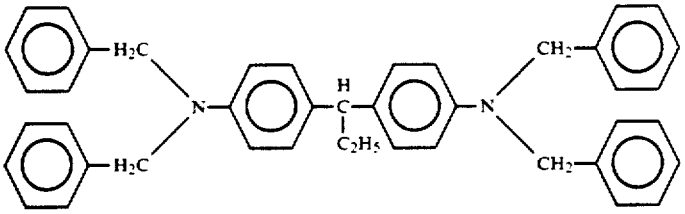

(No. 10)

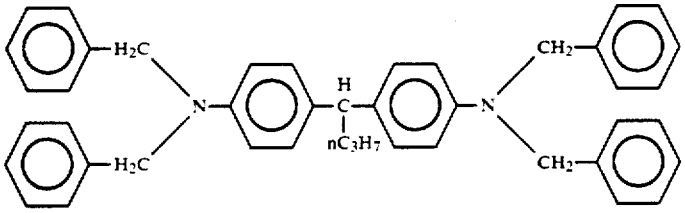

(No. 11)

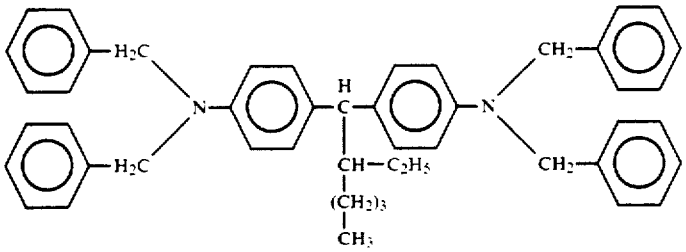

TABLE 1

| Hole | Characteristics of electroluminescent device | | | | | |
|---|---|---|---|---|---|---|
| Example | transporting substance (Compound No.) | Color of light | Light emission starting voltage (V) | Driving current (mA/cm$^2$) | Life (hrs) | Luminance (cd/m$^2$) |
| 1 | No. 1 | Yellow green | +7 | 0.5 to 5 | ≧100 | ≧50 |
| 2 | No. 2 | Yellow green | +5 | 0.3 to 10 | ≧100 | ≧100 |
| 3 | No. 5 | Yellow green | +12 | 1 to 15 | ≧100 | ≧300 |
| 4 | No. 6 | Yellow green | +9 | 0.5 to 12 | ≧100 | ≧200 |
| 5 | No. 9 | Yellow green | +8 | 0.5 to 12 | ≧100 | ≧200 |
| 6 | No. 10 | Yellow green | +6 | 0.2 to 9 | ≧100 | ≧50 |
| 7 | No. 11 | Yellow green | +8 | 0.3 to 10 | ≧100 | ≧100 |

EXAMPLE 8

After washing fully the substrate of non-alkali borosilicated glass having a thickness of 1.1 mm, gold was deposited to a thickness of about 200 Å on the glass substrate to form an anode.

Next, the following compound No. 3 was deposited to a thickness of 800 Å on the anode by vacuum vapor deposition to form a hole transporting layer.

(No. 3)

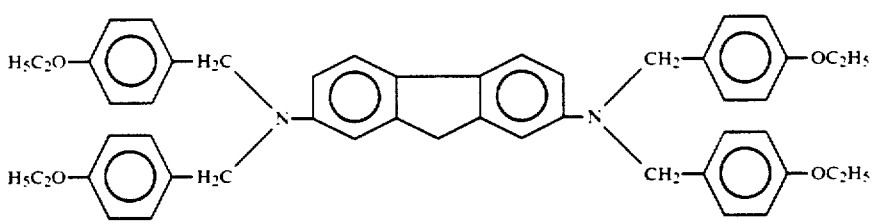

Subsequently, the following derivative of 12-phthaloperinone was deposited to a thickness of about 1,500 Å on the hole transporting layer to form a luminescent layer.

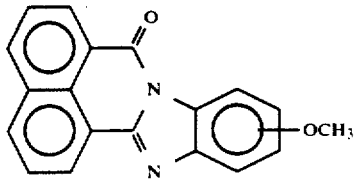

Thereafter, the following derivative of perylene was deposited to a thickness of about 1,000 Å to form an electron transporting layer.

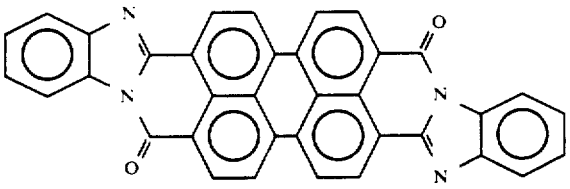

Thereafter, aluminum was deposited to a thickness of about 1,000 Å on the electron transporting layer to form a cathode, thereby obtaining an electroluminescent device shown in FIG. 1. All the materials of the layers were evaporated by the resistance heating method. Thereafter, the leads were connected to the anode and the cathode, and to a D.C. power source. When a current was supplied to the thus-formed electroluminescent device, bright light emission was observed.

It was also found that this electroluminescent device possessed the following characteristics:

Color of radiation : yellow orange

Light emission starting voltage : +25 V

Driving current : 3 to 100 mA/cm$^2$

EXAMPLES 9 to 13

Electroluminescent devices of Examples 9 to 13 were manufactured in the same manner as Example 8 except for using the compounds in Table 2 instead of the compound represented by the formula No. 3 which was used in Example 8 as the hole transporting substance.

The characteristics of these electroluminescent devices are shown in Table 2.

The compounds Nos. 4, 7, 8, 12 and 13 in Table 2 are as follows:

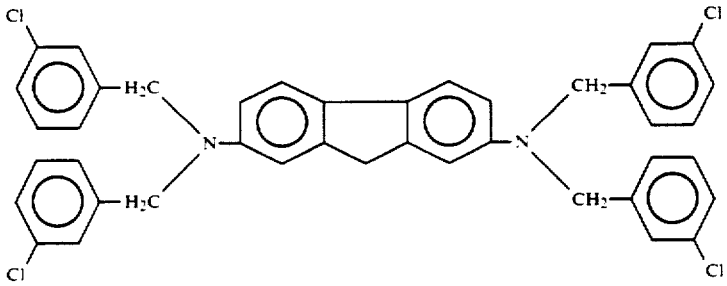

(No. 4)

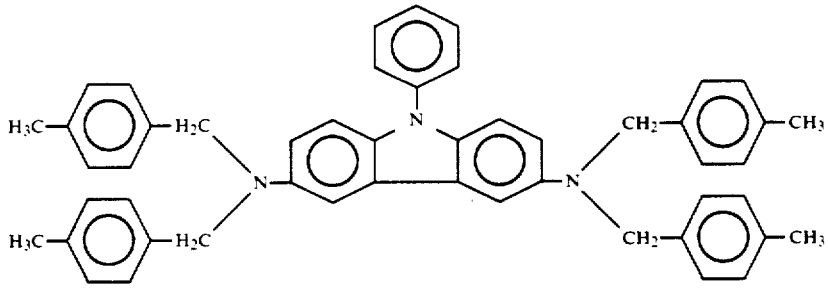

(No. 7)

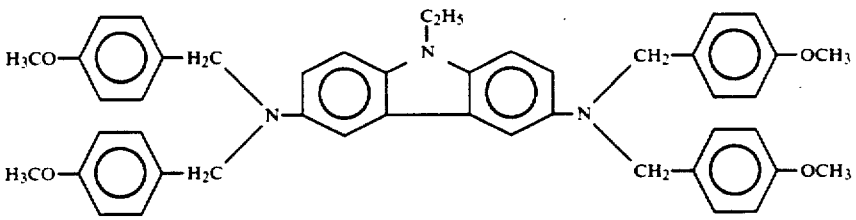

(No. 8)

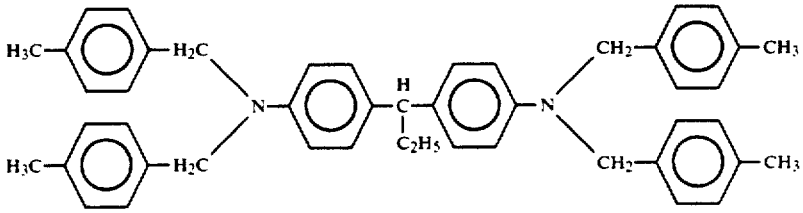

(No. 12)

-continued (No. 13)

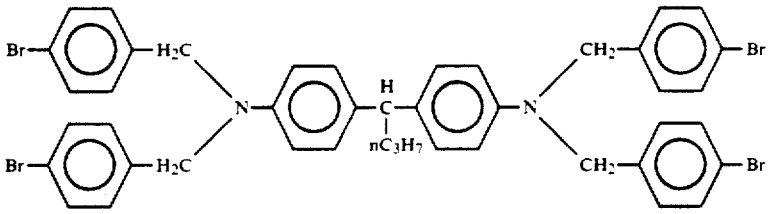

TABLE 2

| Example | Hole transporting substance (Compound No.) | Characteristics of electroluminescent device: Color of light | Light emission starting voltage (V) | Driving current (mA/cm²) | Life (hrs) | Luminance (cd/m²) |
|---|---|---|---|---|---|---|
| 8 | No. 3 | Yellow orange | +25 | 3 to 100 | ≧100 | ≧500 |
| 9 | No. 4 | Yellow orange | +25 | 3 to 90 | ≧100 | ≧300 |
| 10 | No. 7 | Yellow orange | +25 | 5 to 100 | ≧100 | ≧500 |
| 11 | No. 8 | Yellow orange | +25 | 5 to 100 | ≧100 | ≧500 |
| 12 | No. 12 | Yellow orange | +25 | 5 to 100 | ≧100 | ≧500 |
| 13 | No. 13 | Yellow orange | +28 | 5 to 100 | ≧100 | ≧500 |

What is claimed is:

1. An electroluminescent device comprising:

an anode and a cathode; and at least two organic compound layers sandwiched between said anode and said cathode, at least one of said organic compound layers being a hole transporting layer consisting essentially of a compound having the following formula

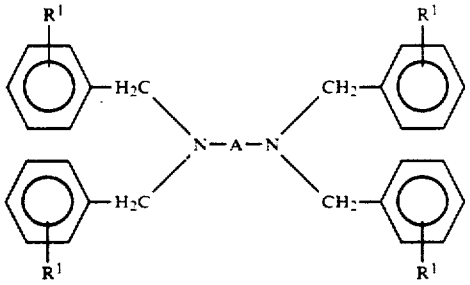

wherein $R^1$ is hydrogen, $C_{1-5}$ alkyl, $C_{1-4}$ alkoxy, halogen or nitro, and A is

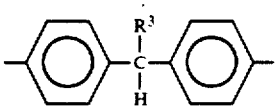

wherein $R^3$ is $C_{1-10}$ alkyl.

2. The electroluminescent device of claim 1, wherein said hole transporting layer consists essentially of a compound having formula I in which $R^1$ is hydrogen, $C_{1-2}$ alkyl, $C_{1-2}$ alkoxy, chlorine or bromine and $R^3$ is $C_{2-7}$ alkyl.

3. The electroluminescent device of claim 1, wherein said hole transporting layer consists essentially of a compound selected from the group consisting of 1,1-bis((dibenzylamino)phenyl)propane, 1,1-bis((dibenzylamino)phenyl)butane, 1,1-bis((dibenzylamino)phenyl)-2-ethylhexane, 1,1-bis((di-4'-methylbenzyl)amino)propane, and 1,1-bis((di-4-'-bromobenzyl)amino)butane.

4. The electroluminescent device of claim 1, wherein said device can be driven by applying a voltage of not more than 30 V.

5. The electroluminescent device of claim 4, wherein said device can be driven by applying a voltage of 5-20 V.

6. The electroluminescent device or claim 1, wherein said device can maintain a luminescence of not less than 10 cd/m².

7. The electroluminescent device of claim 6, wherein said device can maintain a luminescence of not less than 100 cd/m².

8. An electroluminescent device comprising:

an anode and a cathode;

a luminescent layer; and at least two organic compound layers sandwiched between said anode and said cathode, at least one of said organic compound layers being a hole transporting layer consisting essentially of a compound having the following formula

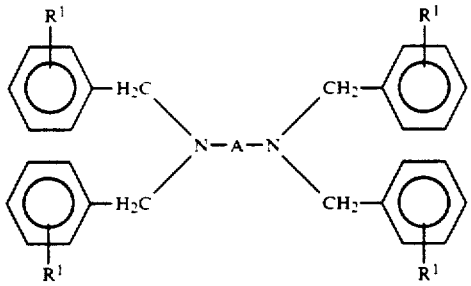

wherein $R^1$ is hydrogen, $C_{1-5}$ alkyl, $C_{1-4}$ alkoxy, halogen or nitro, and A is

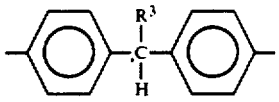

wherein $R^3$ is $C_{1-10}$ alkyl.

9. The electroluminescent device of claim 8, wherein said hole transporting layer consists essentially of a compound having formula I in which $R^1$ is hydrogen, $C_{1-2}$ alkyl, $C_{1-2}$ alkoxy, chlorine or bromine and $R^3$ is $C_{2-7}$ alkyl.

10. The electroluminescent device of claim 8, wherein said hole transporting layer consists essentially of a compound selected from the group consisting of 1,1-bis((dibenzylamino)phenyl)propane, 1,1-bis((dibenzylamino)phenyl)butane, 1,1-bis((di-4'-methylbenzyl)amino propane, and 1,1-bis((di-4'-bromobenzyl)amino)butane.

11. The electroluminescent device of claim 8, wherein said device can be driven by applying a voltage of not more than 30 V.

12. The electroluminescent device of claim 11, wherein said device can be driven by applying a voltage of 5-20 V.

13. The electroluminescent device of claim 30, wherein said device can maintain a luminescence of not less than 10 cd/m$^2$.

14. The electroluminescent device of claim 13, wherein said device can maintain a luminescence of not less than 100 cd/m$^2$.

15. A method of reducing the driving voltage and improving the durability of an electroluminescent device containing an anode, a cathode, a luminescent layer and a hole transport layer, comprising:

sandwiching a hole transport layer consisting essentially of a compound having the following formula

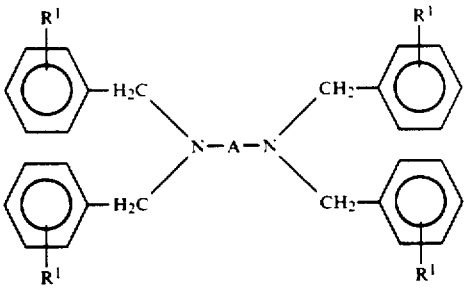

wherein $R^1$ is hydrogen, $C_{1-5}$ alkyl, $C_{1-4}$ alkoxy, halogen or nitro, and A is

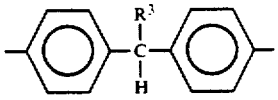

wherein $R^3$ is $C_{1-10}$ alkyl, between said anode and said cathode.

* * * * *